United States Patent [19]

Agin

[11] 4,080,002

[45] Mar. 21, 1978

[54] LOCKING DEVICE FOR MINING MACHINE TRIM CHAIN TAKE-UP

[75] Inventor: Clarence Roy Agin, Columbus, Ohio

[73] Assignee: Dresser Industries, Inc., Dallas, Tex.

[21] Appl. No.: 731,875

[22] Filed: Oct. 13, 1976

[51] Int. Cl.[2] ..... E21C 25/50

[52] U.S. Cl. ..... 299/78; 74/242.1 FP; 74/242.14 R; 299/82

[58] Field of Search ..... 299/1, 78, 76, 64, 82; 74/242.8, 242.1 R, 242.1 A, 242.1 FP, 242.12, 242.14

[56] References Cited

U.S. PATENT DOCUMENTS

| | | | |
|---|---|---|---|
| 3,722,317 | 3/1973 | Johnson | 74/242.14 R |
| 3,765,525 | 10/1973 | Hardwig | 74/242.14 R |
| 3,844,618 | 10/1974 | Delli-Gatti, Jr. | 299/64 |
| 3,950,031 | 4/1976 | Krekeler | 74/242.1 FP |

*Primary Examiner*—Ernest R. Purser
*Assistant Examiner*—William F. Pate, III
*Attorney, Agent, or Firm*—John M. Lorenzen

[57] ABSTRACT

An improved locking device for a trim chain take-up for mining machines in which the trim chain extends around the auger and the auger support arms and is driven by the auger to cut clearance for the support arm. The take-up is slidably mounted behind the auger support arm in guide means affixed to the machine frame. When the take-up is moved away from the support arm to increase the tension on the chain, the locking device moves into the space developed between the take-up and support arm to prevent the take-up from backing off and reducing the chain tension. The locking device comprises a plurality of thin spacers pivotably retained in a side-by-side stacked relationship on a rod mounted to the support arm. The spacers are further disposed such that they are held in an inoperative position resting on the take-up until the take-up has moved past their respective positions whereupon they pivot about the rod into the operative position between the take-up and support arm.

5 Claims, 7 Drawing Figures

LOCKING DEVICE FOR MINING MACHINE TRIM CHAIN TAKE-UP

The invention relates to an improvement in continuous mining machinery, particularly to miners having a rotary drumtype auger supported on arms from the front of the machine, and still more particularly to an improved locking device for the take-up for the trim chain which cuts clearance for the auger support arms.

A mining machine of the general type referred to is described in U.S. Pat. No. 3,318,638. It consists of a frame mounted on crawlers, a cutting head and a gathering head mounted at the forward end of the frame, and central conveyor extending from the gathering head to the rear of the machine. The cutting head comprises a drum-type auger disposed on an axis transverse to the machine centerline and parallel to the mine face. The auger is supported from the forward end of the frame by arms which also enclose the gearing which transmits rotary motion to the auger.

In many such machines, such as the one shown in the aforementioned patent, a trim chain is provided to cut clearance for the auger support arms. The chain, which is fitted with cutting bits, extends around a sprocket on the rotary auger and is driven by the same. The chain also passes around an idler sprocket usually mounted rearward of the support arms in an open framework formed by the auger gear case housing.

Because of the rough cutting job required of the trim chain and because of the rugged mine environment, the chains tend to wear and stretch rapidly. Therefore, the idler sprocket is part of a take-up device which allows adjustment to correct the chain tension for optimum chain performance. Heretofore, the take-up devices have usually been a sprocket mounted on a holder which can be moved away from the support arms by a mechanical lead screw. This device is typical of take-up devices used in many other applications. However, in the mine environment mechanical lead screws are found to corrode and jam or freeze, thereby making the job of adjusting chain tension difficult.

An alternative to mechanical lead screws, hydraulic means, such as a push type cylinder, have been used in some cases. The difficulty in maintaining adequate pressure in the hydraulic cylinder has required the addition of mechanical locking devices to prevent the take-up from receding when the pressure to the cylinder recedes. But so far none have been suitable for the application.

It is therefore the principal object of the invention to provide a take-up for trim chains which incorporates a locking device that is dependable, simple and economical to manufacture, easy to operate, and which overcomes other of the problems encountered with the prior art such devices.

This is achieved by a sprocketless take-up comprising a cylindrical roller mounted for free rotation in a yoke. The yoke is slideably mounted in guides affixed to the auger gear case frame such that the yoke and roller can move away from the auger support arm to adjust the trim chain tension. A simple hydraulic cylinder integral with the yoke pushes against the support arm housing to tighten the chain.

The improved locking device includes a plurality of thin spacers retained in a horizontally stacked relationship by a rod affixed to the auger support arm or auger gear case and passing freely through holes in the spacers. The independent spacers are stored in an inoperative condition resting on top of the take-up. When the take-up moves away from the support arms, the spacers individually rotate about the rod into an operative condition in the space between the take-up and support arm developed as the take-up passes their respective positions. As desired, the spacers can either be made self-actuating or such that they must be manually moved into position.

This take-up device has several features which provide advantages over the prior art devices. The idler roller provides smoother chain action than the sprockets used before. The yoke is rugged, yet simple in design. It is strong enough to withstand the high chain tension, and, as mounted in the slide guides, moves dependably and smoothly when adjustment is necessary. There is no lead screw to corrode or otherwise freeze up.

The hydraulic device for effecting adjustment of the take-up is a simple grease cylinder incorporated into the yoke itself. The piston of this cylinder pushes against the auger support arm housing when actuated.

The use of this simple hydraulic device is made possible by the concurrent use of the improved locking device which immediately moves into place where it can take all or part of the load off the cylinder. The locking device offers the features that it is self-storing, allows adjustment in acceptably small increments, and can be self-actuating.

A more detailed description of the invention and its distinguishing features follows below with reference to the accompanying drawings which form part of this specification and of which:

Figure 3:
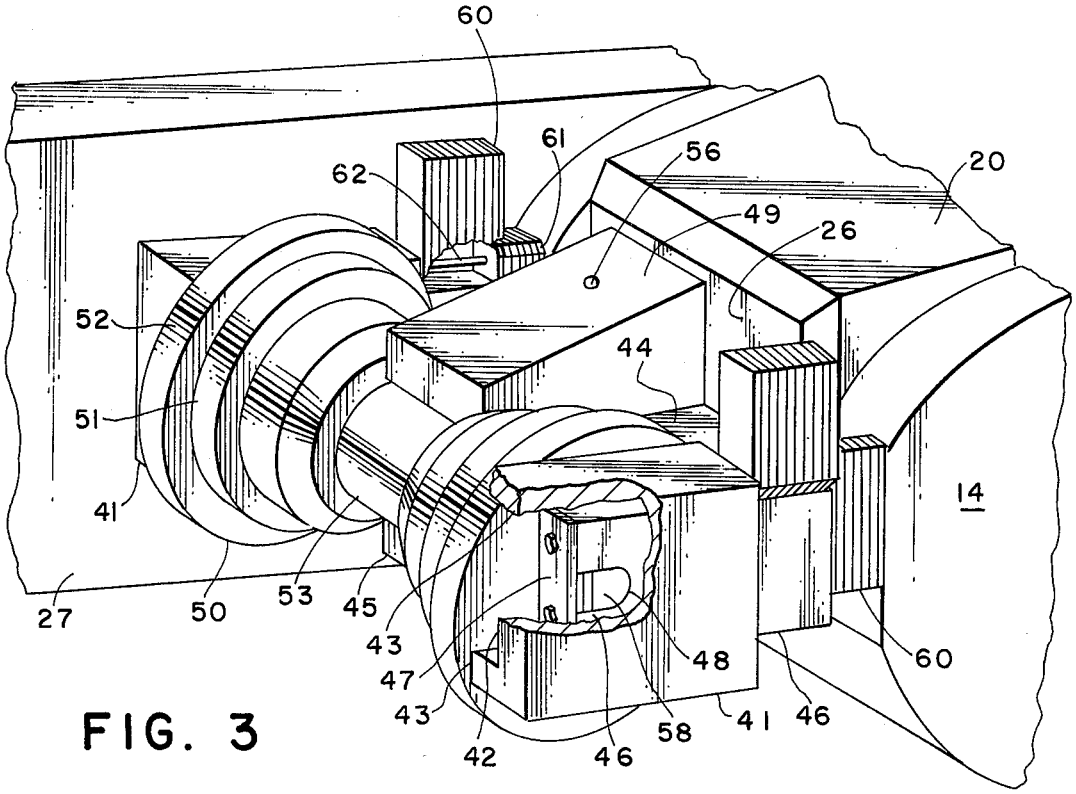
FIG. 3 is an isometric view of an improved trim chain take-up and locking device embodying the invention.
Figure 6:
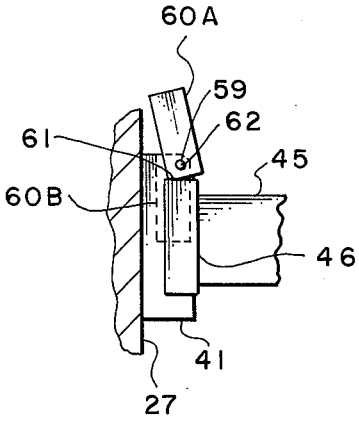
Figure 6A:
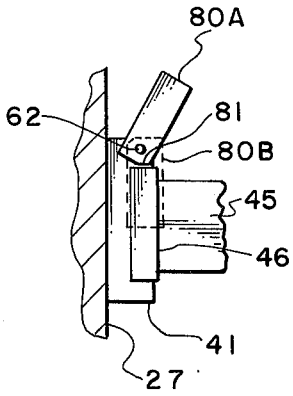
Figure 4:
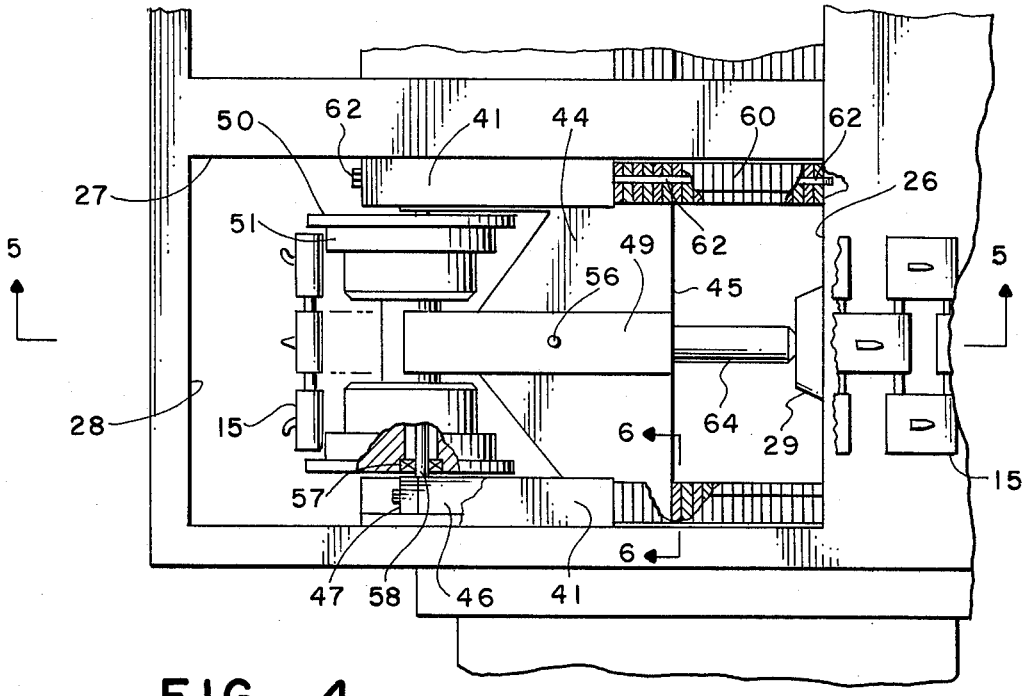
FIG. 4 is a plan view of the take-up and locking device of FIG. 3.
Figure 5:
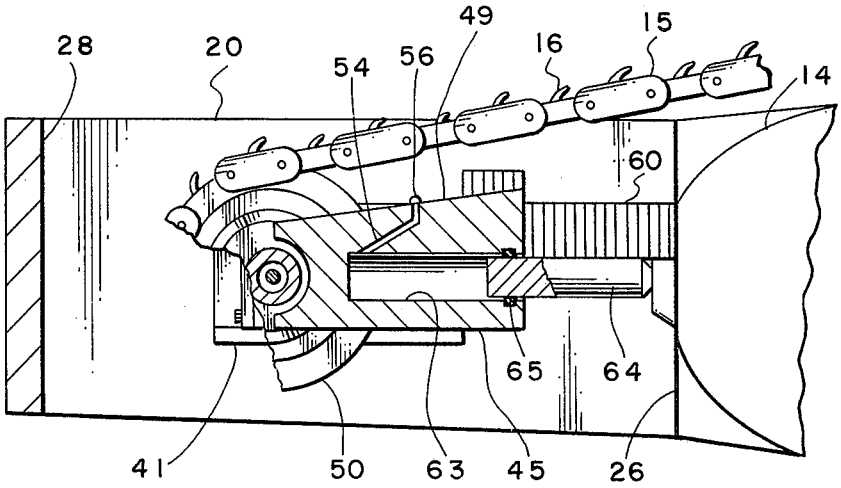
FIG. 5 is a side elevation view partly in section as taken along the line 5—5 in FIG. 4.

FIG. 6 is a partial elevation view in section as taken along the line 6—6 in FIG. 4; and FIG. 6*a* is also a partial elevation view in section as taken along the line 6—6 in FIG. 4 showing an alternate embodiment of the locking device of FIGS. 3 through 5.

Figure 1:
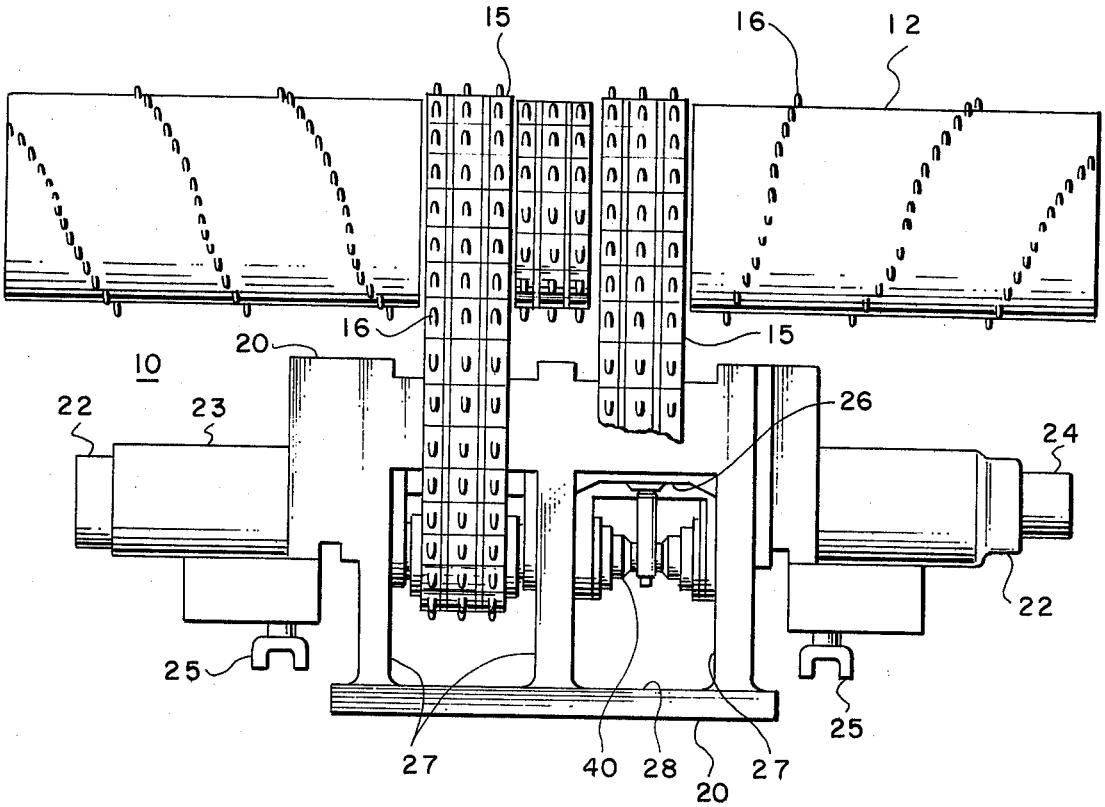
FIG. 1 is a plan view of the cutting head of a continuous drum type mining machine showing a representative application for the invention.
Figure 2:
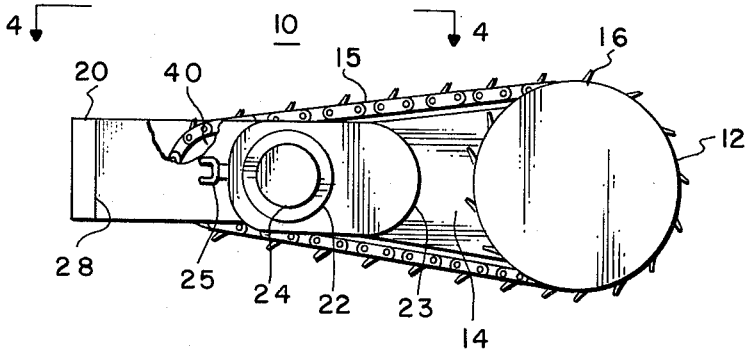
FIG. 2 is a side elevation of the cutting head shown in FIG. 1.

FIGS. 1 and 2 show a representative cutting head 10 from a mining machine. As used herein the term cutting head includes the rotary cutting drum or auger 12, the auger gear case designated generally at 20, the auger support arms 14 and the trim chains 15. The auger and trim chains are provided with cutting bits 16 which do the actual mining.

The back wall 28 of gear case 20 bolts rigidly to the frame of the mining machine. There are usually two motors on the machine which transmit power respectively to the right and left sides of the gear case 20 through mechanical shafts connected to the universal connections 25. The power is further transmitted through reduction gearing in the housing 23 and through gearing enclosed in the auger support arms 14 to the auger head 12. The gear case 20 further includes clutch and brake units 22 and 24 respectively.

Two openings in the gear case 20 are formed by the walls 26, 27 and 28. The auger support arms are integral with the gear head 20. Each trim chain is driven by a sprocket on the auger head and passes around the respective support arm 14 and through the opening in the gear case. A take-up unit 40 is mounted to the gear case 20 in the opening and works against the wall 26 to tension the trim chain 15. Since the support arms are ridigly attached to the gear case, in the discussion which follows the wall 26 is also referred to as the back of the auger support arm, and walls 27 and 28 can be considered part of the machine framework.

Referring now to FIGS. 3 through 6, the take-up 40 is shown in greater detail. Unlike the prior art take-ups which used idler sprockets, the present take-up uses a freely rotatable roller 50 which provides a smoother chain operation and steady rather than jerking forces on the take-up. The trim chain rides on the cylindrical bearing surfaces 51 of the roller between the aligning and retaining flanges 52.

The idler roller 50 is mounted on bearings 57 on the inner non-rotatable shaft 58. The shaft 58 is in turn mounted in a hoke 45. The hoke includes a central vertical rib 49 and two vertically oriented slide plates 46 which are connected on opposite sides of the rib 49 by lateral webs 44 in an integral structure. The flattened opposite ends of shaft 58 are held in matching slots 48 in the respective slide plates 46 by the retainers 47 which bolt to the side plates. A semicircular recess in the rib 49 is spaced slightly from the outer hub 53 which extends rigidly between the bearing surfaces 52 of the roller 50.

The end plates 46 of the yoke 45 are slidably mounted in guide blocks 41 which are in turn ridigly attached to the opposite side walls 27 of the opening in the auger gear case. The guide blocks 41 consist of a vertical wall 42 connecting two inwardly extending flanges 43.

A simple hydraulic device in the form of a grease cylinder is incorporated in the yoke member 45. A cylindrical grease chamber 63 extends into the yoke from the end opposite the roller 50. A cylindrical piston 64 is mounted in the chamber 63 through an O-ring or other seal means 65. Passageway 54 connects the grease chamber 63 to a grease fitting 56 accessible on top of the yoke 45.

When grease under pressure is introduced into the chamber 63, the piston 65 extends out against the wall 26 at the back end of the auger support arm. This action causes the yoke 45 to slide in guides 41 away from the wall 26 and thereby tighten the trim chain 15. Thus when a trim chain becomes worn or stretched, adjustment of the chain tension is accomplished by this grease cylinder and regulated by control of the pressure applied to it.

While this simple device works well, other types of fluid actuated devices, such as air or hydraulic oil cylinders could be used instead to effect movement of the yoke 45. It should also be readily apparent that the cylinder could be incorporated in or attached to the gear case 20 or support arm 14, but the described arrangement is considered more convenient.

As mentioned earlier, although the hydraulic cylinder is effective to adjust chain tension initially, it is difficult to maintain the applied pressure during operation of the machine in order to maintain the chain tension. This problem is further affected by the jerking action of the chain when it is cutting into the mine face.

Therefore it has been found desirable to include a locking device as part of the take-up unit. A few such devices have been tried previously in the past with less than satisfactory results. In one design a series of individual spacers were manually placed between the take-up and the auger support arm. In another a plate connected to the movable take-up was provided with a series of spaced holes which would successively pass over a matching hole fixed permanently with respect to the support arm when the take-up moved. After the chain was adjusted, a pin or rod was inserted into the matching holes to lock the take-up in place. This device proved to have a couple of serious drawbacks. First, since the pins had to be sufficiently large to withstand the forces exerted by the chain, adjustment could only be made in sizeable increments, usually of 7/8 inch or more. Secondly, a locking device is generally required on each side of the take-up, and occasionally the operator would get a pin on one side in a different hole than on the other side. This resulted in the unit being cocked leading to wear and failure of the chain and/or take-up unit.

The present take-up also incorporates an improved locking device as shown in FIGS. 3 through 6. In the particular embodiment shown, the device comprises a plurality of individual spacers or shims 60 held in a horizontally stacked arrangement by a rod 62 which extends from the upper flange 43 of the guide block 41 to the wall 26 of the auger support arm. The rod passes freely through larger diameter holes in each of the shims 60, and is anchored at its ends by any convenient means such as a threaded connection.

The holes 59 in the generally rectangular spacers are located off center with respect to the length of the spacer such that in the stored or inoperative condition 60A, as shown in FIG. 6, the short end of the spacer rests on the upper surface of the end plates 46 of the yoke 45. When it is necessary to take up slack in the trim chain, the grease cylinder is actuated as previously described and the take-up 40 moves away from the support arm 14 leaving a gap between the yoke 45 and the wall 26. As the trailing end of the yoke moves from under their respective positions, the spacers 60 individually rotate into the operative position 60B with their longer end in the space between the take-up and the wall 26. Collectively the operative spacers 60B fill the space between the yoke 45 and the wall 26 and maintain the position of the take-up and accordingly the chain tension even when the pressure on the grease cylinder decreases.

As shown in FIGS. 3 and 6, the spacers 60 are beveled at their short end, as indicated at 61, so that, in the inoperative condition 60A they lean slightly toward the side walls 27 of the gear case. This is a matter of design choice to guard against the spacers pivoting prematurely during the harsh vibrations encountered when the machine is in operation. With this design it is necessary for the operator, when adjusting chain tension, to manually flip the appropriate spacers into the operative condition. This step requires such little time and effort as not to be considered a detraction from the other advantages offered by this locking device.

However, as an alternative design choice the locking device can be made self-actuating in a number of conceivable ways, such as it is shown in FIG. 6a. In this design the spacers 80 are beveled at the opposite corner, as indicated at 81 such that in the inoperative condition 80A they lean away from the gear case wall 27. When the take-up moves from under their position the spacers 80 rotate about the rod 62 under their own weight into the operative position 80B.

It should be apparent that the particular design of this locking device, and particularly the spacers 60, could be varied considerably within the basic concept according to the particular preferences of the designer. For instance other means for freely suspending the spacers in horizontally stacked relationship could be substituted for the rod 62. Further, the rod 62 could be attached in various ways and in various locations to the framework of the machine so long as the spacers are retained fixed in relation to their individual distances from the wall 26 of the support arm. As an alternative to the bevel 61 of the spacers in FIG. 6, other means to restrain the spacers from pivoting from their stored condition without manual assistance could be provided by a removable mechanical cover or by restraining means on the surface of the yoke 45. And as an alternate to the design of the spacers 80 in FIG. 6a, the shape of the spacers could be otherwise as long as in the inoperative condition they are unbalanced on the rod 62 and ready to pivot into the operative condition as soon as the take-up clears their position.

Although it may not be necessary in all applications, it is considered to have a locking device on each side of the take-up 40 to prevent cocking and uneven wear of parts.

The locking device described offers distinct advantages over the prior art devices. The spacers 60 can be made as thin as desired within practical limitations and therefore adjustment can be provided in as small increments as desired. All parts are captured and retained in the assembly, and the device can be made self-actuating as described above.

The embodiments of the invention in which an exclusive property or privilege is claimed are defined as follows:

1. An improved trim chain take-up for a mining machine in which a rotary auger is supported by one or more perpendicular arms extending from the machine frame and wherein a trim chain extends around each support arm and the auger and is driven by the auger to cut clearance for the respective support arm, said take-up comprising:

a yoke slideably mounted behind the support arm in guide means affixed to the framework of the machine;

an idler mounted in the yoke and adapted to bear against the interior of the trim chain;

pressure actuated push means mounted between the yoke and support arm and effective when actuated to push the yoke and idler away from the support arm to increase the tension of the trim chain; and locking means including a plurality of individual spacers pivotably mounted in a horizontally stacked relationship on a pivot extending through the stack and connected to the auger arm, said spacers being shaped and positioned such that they rest in an inoperative condition on the top of the yoke when the take-up is retracted and such that when the take-up is extended and the yoke moves away from the auger support and from beneath each successive spacer, that spacer will rotate about the pivot into an operative position between the yoke and auger support arm, said operative spacers being collectively effective to block the take-up from retracting and relieving tension on the trim chain when pressure on the push means is reduced.

2. The take-up device as described in claim 1, wherein the pivot in the locking means is a cylindrical rod extending between the guide means and the auger support arm.

3. The take-up device as described in claim 1, wherein the spacers are relatively thin and generally rectangular shaped shims each having a hole located off-center respective to the length of the shim and through which the pivot fits freely.

4. A locking device for a trim chain take-up in a mining machine having a rotary auger supported by an arm and a trim chain driven by the auger and extending around the support arm to cut clearance for the arm, wherein the take-up is mounted behind the auger support arm for movement away from the arm to adjust the tension on the trim chain, said device comprising:

a plurality of individual spacers pivotably mounted in horizontally stacked relationship on pivot means connected to the auger support arm such that when the take-up is retracted the spacers are stored in an inoperative position resting against the top of the take-up, but as the take-up extends and moves away from the support arm and from beneath each successive spacer, that spacer will rotate about the pivot into an operative position between the yoke and auger support arm, said operative spacers being collectively effective to block the take-up from retracting and relieving tension on the trim chain when pressure on the push means is reduced.

5. A locking device for a mining machine trim chain take-up, where the take-up is mounted such that it moves away from a part of the machine frame when taking up slack in the trim chain, and wherein the machine includes hydraulic means to effect such movement of the take-up, said device comprising:

a plurality of individual spacers pivotably mounted in side-by-side relationship on the machine in such a manner that when the take-up moves to tension the chain, the spacers individually and sequentially pivot into position between the take-up and said machine frame to block the take-up from retreating.

* * * * *